US006564723B2

(12) United States Patent
Shapton

(10) Patent No.: US 6,564,723 B2
(45) **Date of Patent: *May 20, 2003**

(54) UTILITY FURNITURE SYSTEM

(75) Inventor: Robert J. Shapton, East Grand Rapids, MI (US)

(73) Assignees: Thornberry Furniture, Ltd, Muskegon, MI (US); Harbor Steel & Supply Corp., Muskegon, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/299,040

(22) Filed: Apr. 23, 1999

(65) Prior Publication Data

US 2001/0003264 A1 Jun. 14, 2001

Related U.S. Application Data

(60) Provisional application No. 60/083,422, filed on Apr. 29, 1998.

(51) Int. Cl.[7] ..... A47B 37/00
(52) U.S. Cl. ..... 108/50.02; 312/223.6
(58) Field of Search ..... 108/50.02, 50.01, 108/50.11, 23, 60; 312/223.3, 223.6

(56) References Cited

U.S. PATENT DOCUMENTS 4,807,540 A * 2/1989 Priesemuth ..... 108/60
5,121,698 A * 6/1992 Kelley ..... 108/50.02 X
5,394,658 A * 3/1995 Schreiner et al. .... 312/223.6 X
5,473,994 A * 12/1995 Foley et al. ..... 108/50.02
5,640,912 A * 6/1997 Diffrient ..... 108/50.02
5,673,632 A * 10/1997 Sykes ..... 108/50.02 X
5,694,862 A * 12/1997 Grubb ..... 108/50.11
5,704,298 A * 1/1998 Corpuz, Jr. et al. ..... 108/50.01
5,853,236 A * 12/1998 Rogers et al. ..... 312/223.6
5,988,076 A * 11/1999 Vander Park ..... 108/50.02

FOREIGN PATENT DOCUMENTS

EP 620990 * 10/1994

* cited by examiner

*Primary Examiner*—Jose V. Chen
(74) *Attorney, Agent, or Firm*—Miller, Johnson, Snell & Cummiskey, P.L.C.

(57) ABSTRACT

A desk providing a work surface and having a top, a bottom, a perimeter edge, and a U-shaped channel disposed below the top of the work surface adjacent the perimeter edge. The U-shaped channel includes a vertical member extending downwardly from the work surface proximate the perimeter edge, a bridge member, and a back member extending upwardly from the bridge member and spaced from the vertical member. A plurality of legs are attached to the bottom of the work surface to support the work surface a predetermined distance above a floor. The desk may be fitted with a return rotatably attached to at least one of the plurality of legs such that the return can be rotated under the work surface when not in use.

20 Claims, 11 Drawing Sheets

UTILITY FURNITURE SYSTEM

This application claims priority to United States Provisional Application No. 60/083,422, filed Apr. 29, 1998.

BACKGROUND OF THE INVENTION

This invention relates generally to furniture, and more particularly to furniture used in an office, or home office environment.

Today's businesses rely heavily upon a variety of different electrical apparatus as the primary means by which information is received and disseminated. Thus, it is almost invariable that every desk encountered in a business environment supports one or more of these electronic apparatus. Common to most every office desk is at least a computer and a telephone. However, there are a variety of other devices that are normally positioned atop a business desk. Such other apparatus includes dictation/recorders, computer printers, computer scanners, telephone answering machines, facsimile machines, paper copiers and image scanners. Each of these office tools contain at least one electrical cable and may include additional cables permitting electrical communication with other devices. For example, such additional cables include the cable connecting the computer to the computer printer, the telephone cable between the facsimile machine and the telephone outlet and the connection between an image scanner and a computer.

Depending upon the particular arrangement of devices on the desk, these cables are often strewn in a haphazard arrangement on the top of the desk. This arrangement is unacceptable because it decreases the effective area in which a person can work. Also, many of these cables are positioned such that they partially hang over the back of the desk. This arrangement produces a visually unpleasant work environment. Moreover, if the particular desk is in a common area through which people frequently pass, there exists the potential for inadvertent contact with the cables which can damage the cables. In addition, a passing individual may become entangled in these cables and, as a result, pull the dedicated electrical apparatus from the desk causing irreparable damage to the electrical apparatus and personal injury.

Additionally, in order to provide maximum space utilization, many offices are arranged such that the individual desks are positioned in an open area. As a result, persons working in this environment do not enjoy a sense of privacy. Furthermore, the typical office desk does not afford the worker any appreciable degree of modesty, i.e. privacy for the area existing below the worksurface of the desk.

Another shortcoming with respect to present day office furniture is in the area of conference tables. Normal conference tables comprise a substantially rectangular, horizontal worksurface with a series of legs depending therefrom. During meetings, presentations, and seminars, one or more electrical apparatus are often used to convey information. In this context, such electrical devices include overhead projectors, slide projectors, film projectors, and phone teleconferencing equipment. To use these devices, one must normally attach the electrical cable to the electrical outlet positioned in the wall adjacent to the conference table. Thus, the cable hangs over a side of the conference table and prevents individuals from moving freely about the conference room.

Therefore, there exists a need for an office furniture system which effectively eliminate the problems extant in the prior art and is cost effective to manufacture.

SUMMARY OF THE INVENTION

Accordingly the present invention advances a new and unique office furniture system which successfully eliminates problems unaddressed by the prior art. According to one preferred aspect of the invention, the office furniture system is embodied in a utility desk having a cable channel depending from the back of the worksurface. This cable channel is dimensioned to accept the electrical cables connected to the electrical apparatus positioned on the worksurface. In accepting these electrical cables, the cable channel improves the visual appearance of the work area and prevents inadvertent contact between individuals and the electrical cables. In addition, placement of the electrical cables within the channel increases the effective workspace area. Moreover, the cable channel depends a preselected distance below the worksurface and thereby provides the worker with a degree of modesty.

According to another preferred aspect of the invention, the desk includes a vertical back extending from the cable channel. The top of the back may contain a horizontal shelf extending therefrom, thereby providing an additional worksurface. Also, the vertical back may be formed with a window having an adjustable shade positioned thereover. This vertical back in combination with the window provides the worker with a degree of privacy.

According to another aspect of the invention, the pair of legs positioned proximate to the back of the worksurface are equipped with rollers. These rollers facilitate movement of the desk when rearrangement of the work area is required.

According to still another aspect of the invention, the desk includes a return rotatably attached to a front leg of the desk. The return is equipped with a pair of legs having rollers attached thereto, permitting the return to be rotated about the leg of the desk. Thus, the return provides an additional work surface and can be positioned under the worksurface of the desk when not in use.

According to yet another aspect of the invention, a conference table is provided having a generally rectangular worksurface with four legs depending therefrom. The front of the worksurface is formed with a cutout section while the pair of legs positioned proximate to the front of the worksurface are fitted with rollers to thereby provide mobility. In a preferred embodiment, two individual conference tables are juxtaposed such that the front surfaces of the adjacent conference tables are in abutting contact, with the cutout sections of the respective tables in registration. When so positioned, these conference tables create an enlarged cutout section dimensioned to enable electrical cables to extend therethrough.

These and other advantages, benefits and objects will be understood by one skilled in the art from the drawings, description and claims which follow.

DESCRIPTION OF THE PREFERRED EMBODIMENTS

Figure 2A:
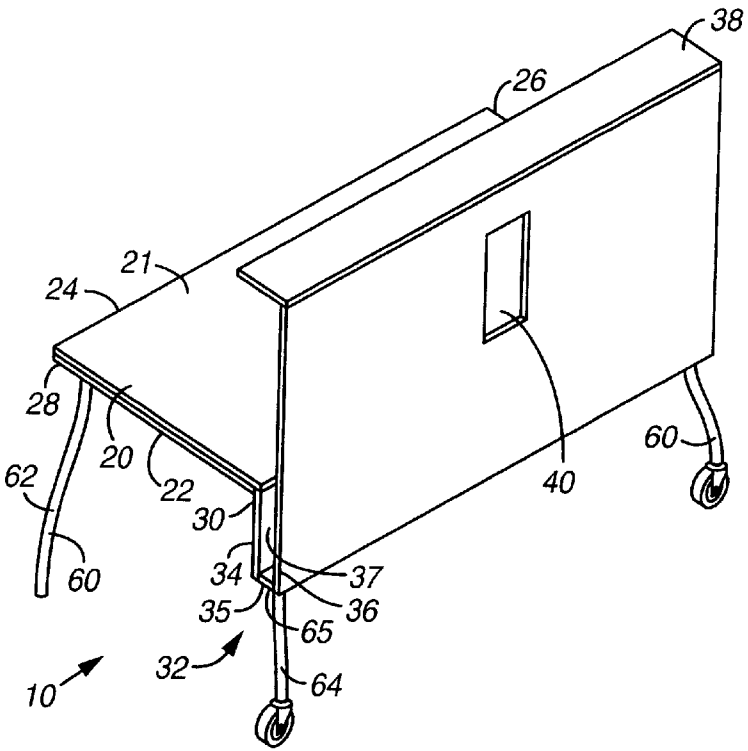
FIG. 2*a* is a rear perspective view of the desk illustrated in FIG. 1.
Figure 1:
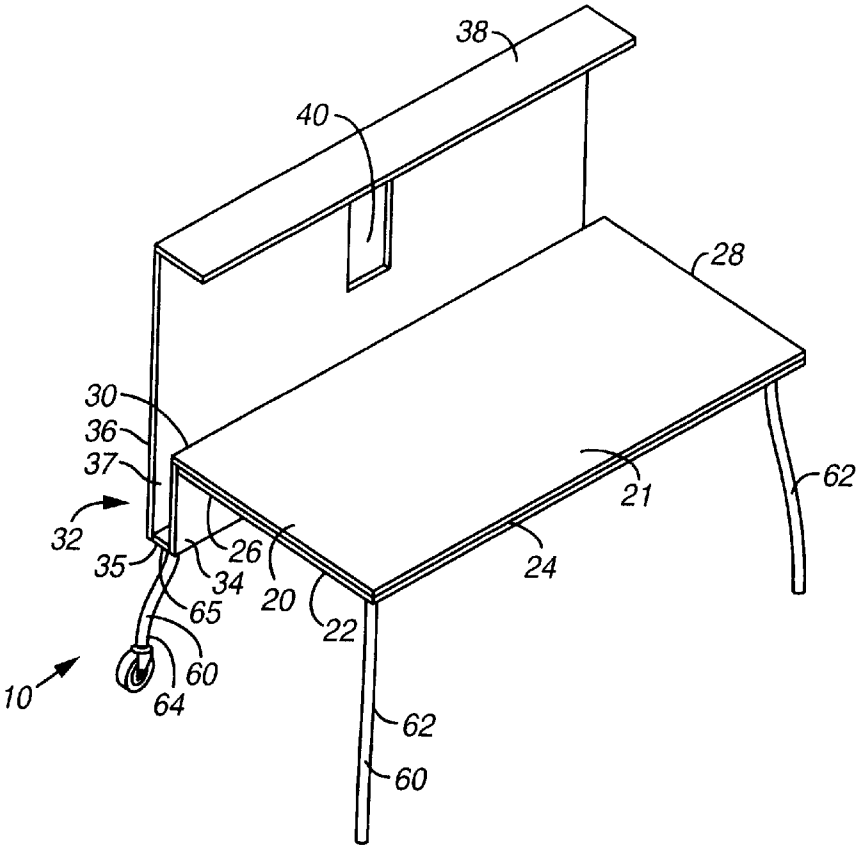
FIG. 1 is a front perspective view of a utility desk according to the present invention.
Figure 2B:
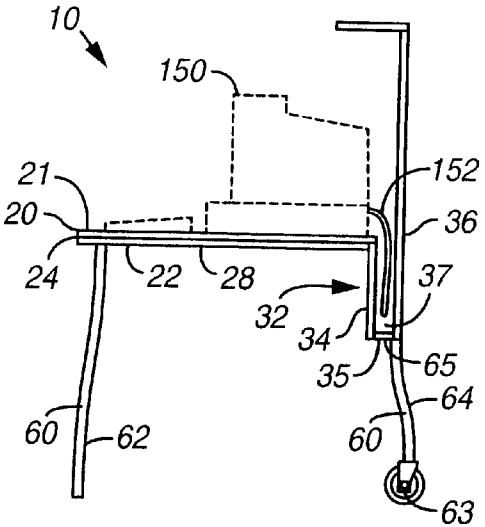
FIG. 2*b* is a side view of the desk illustrated in FIGS. 1 and 2*a* shown supporting a computer depicted in phantom.
Figure 10:
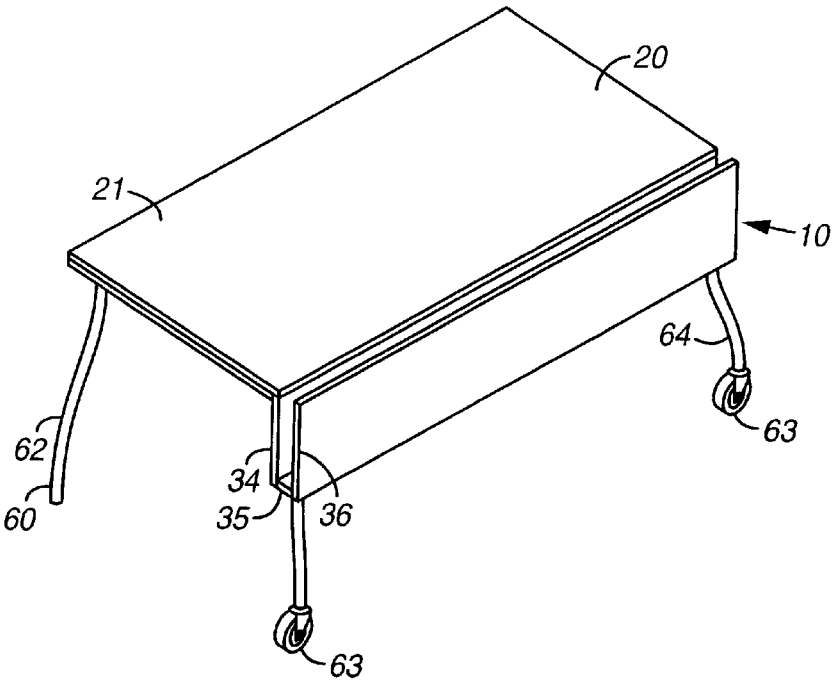
FIG. 10 is a rear perspective view of the utility desk illustrated in FIG. 9.
Figure 9:
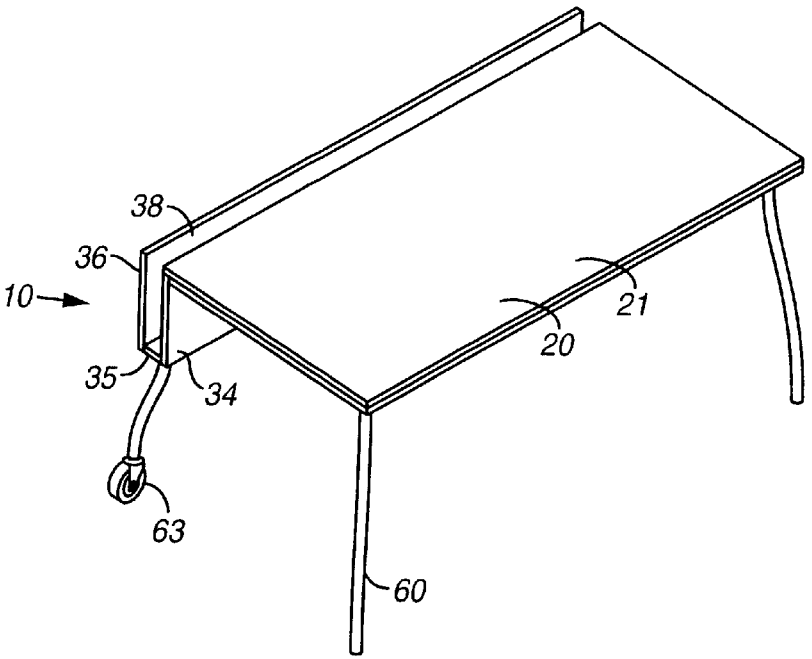
FIG. 9 is a front perspective view of a utility desk according to another alternative embodiment of the invention.

The present invention is embodied in a unique desk particularly suited for office or home use. Turning now to FIGS. 1, 2*a* and 2*b,* there is shown a desk according to a preferred embodiment of the present invention, and generally designated by reference numeral 10. Desk 10 contains a worksurface 20 and a plurality of legs 60 depending from bottom surface 22 of worksurface 20. Legs 60 support worksurface 20 a preselected distance above the floor. Worksurface 20 is of a generally rectangular shape having a front 24, opposing sides 26, 28 and a rear 30. Depending from rear 30 of worksurface 20 is a cable channel 32. Cable channel 32 spans from side 26 to side 28 and depends a preselected distance from rear 30 of worksurface 20. Cable channel 32 includes a vertical member 34 attached to rear 30 of worksurface 20 and a vertical back 36. Vertical member 34 and back 36 are joined by a horizontal bridge member 35 and hence defines an interior 37 between vertical member 34 and back 36. As shown in FIG. 2*b,* interior 37 is dimensioned to receive one or more electrical cables 152 attached to an electrical apparatus 150 positioned on top 21 of worksurface 20. As illustrated, electrical device 150 is a computer, however, it will be recognized by those with ordinary skill in the art that electrical device 150 may be any electrical device commonly used in a home or business office environment. As shown in FIGS. 9 and 10, top 38 of back 36 may be approximately coplanar with top 21 of work surface 20.

Figure 8:
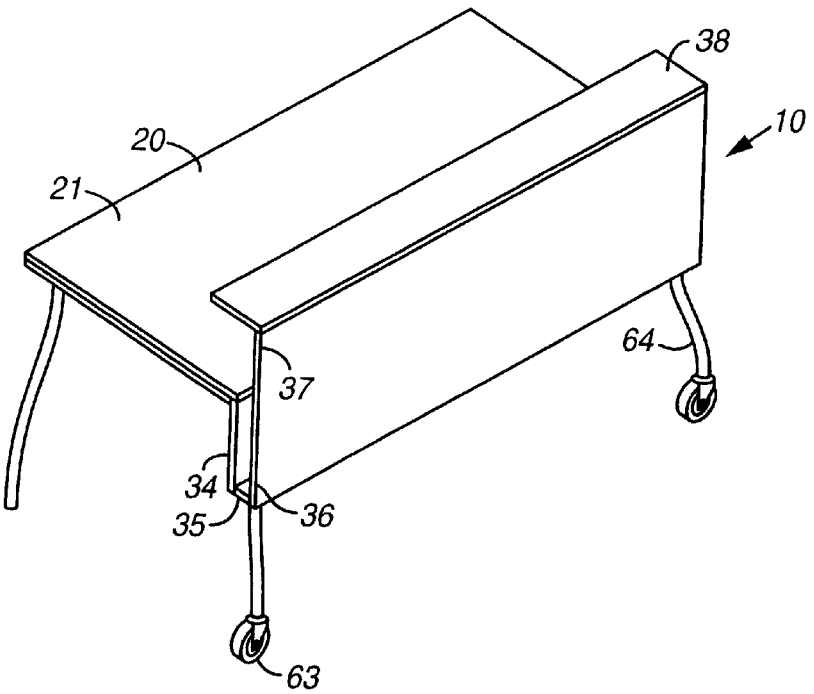
FIG. 8 is a rear perspective view of the utility desk illustrated in FIG. 7.
Figure 7:
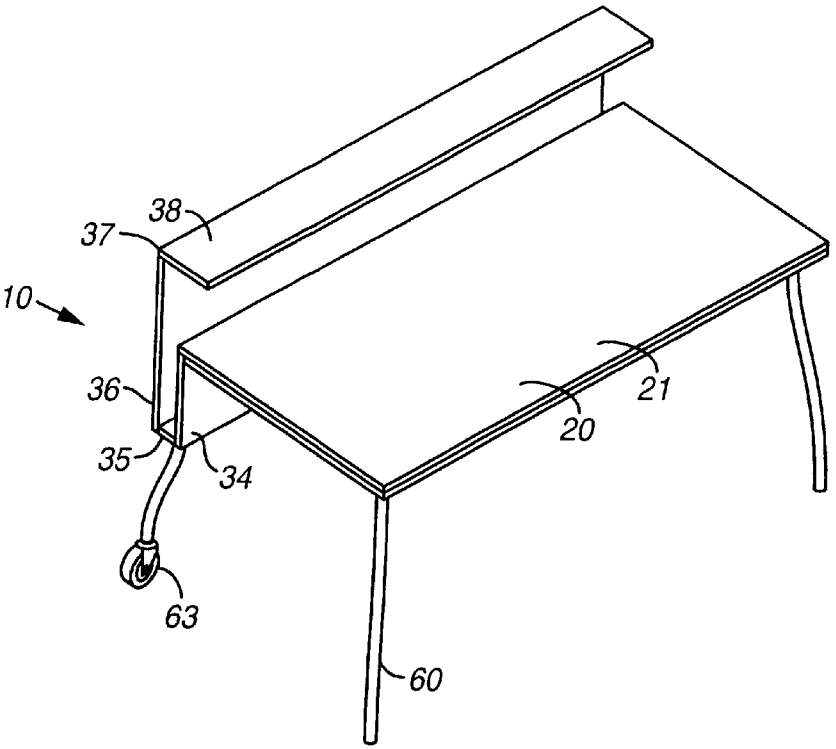
FIG. 7 is a front perspective view of a utility desk according to an alternative preferred embodiment of the present invention.

In an alternative preferred embodiment as shown in FIGS. 7 and 8, back 36 may extend above the plane defined by top 21 of work surface 20. A shelf 38 extends substantially horizontally from top 37 of back 36. Preferably, shelf 38 extends in a direction towards work surface 20.

Figure 6:
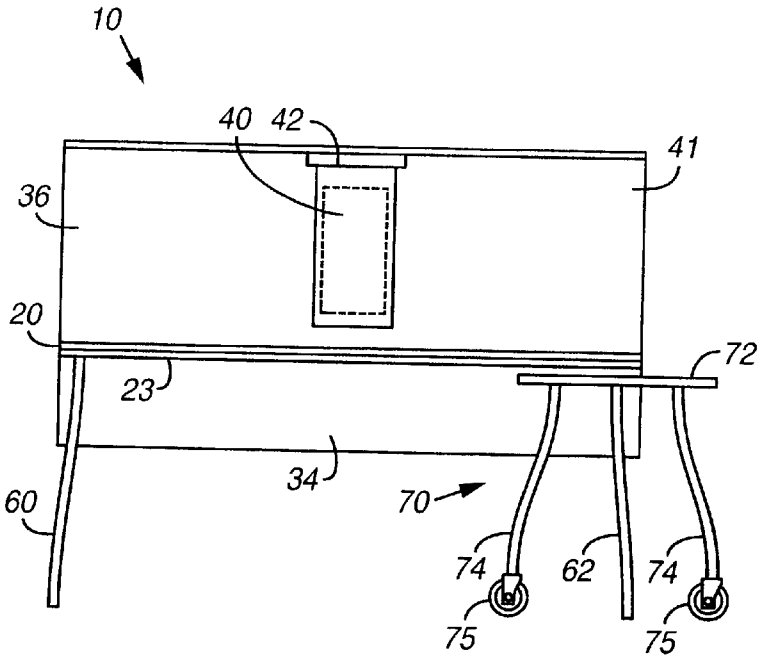
FIG. 6 is a front view of the utility desk of FIG. 5 with the shade shown in the drawn position.
Figure 5:
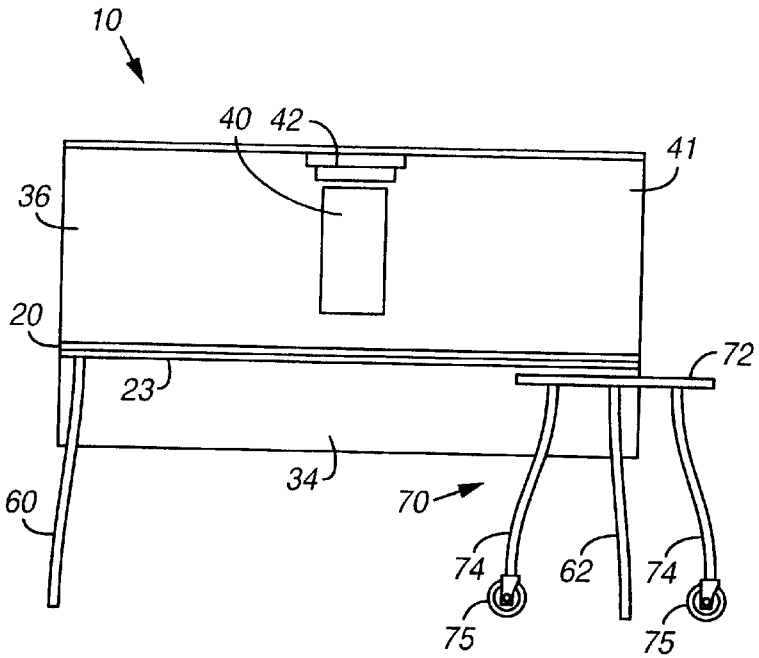
FIG. 5 is a front view of a utility desk according to the invention illustrating both a return and a window shade.

In the most preferred embodiment, as shown in FIGS. 1, 2*a* and 2*b,* back 36 extends a greater distance above the plane defined by top 21 of work surface 20 than back 36 of FIGS. 7 and 8. In this embodiment, back 36 is fitted with a window 40. As shown in FIGS. 5 and 6, interior surface 41 of back 36 supports a shade 42 which can be adjustably positioned over window 40. As shown in FIG. 5, shade 42 is illustrated in the open position whereas FIG. 6 illustrates shade 42 in the drawn position, thereby covering window 40. In the most preferred form, window 40 is approximately thirteen and one quarter inches high and six inches wide, but other dimensions may be acceptably utilized. Alternatively, a plurality of windows 40 may be located in back 36.

Desk 10 is supported a preselected distance above the floor by a pair of front legs 62 attached proximate to front 24 and a pair of rear legs 64 depending from exterior surface 65 of bridge member 35. As shown, legs 64 are slightly curved, however it will be appreciated by those with ordinary skill in the art that legs 64 may assume any shape without departing from the spirit and scope of the present invention. Preferably, rear legs 64 are fitted with rollers or casters 63 to facilitate the movement of desk 10. Additionally, one or both of front legs 62 may be fitted with glides or levelers (not shown) which serve to adjust legs 62 when desk 10 is positioned on a non-level floor.

Figure 3:
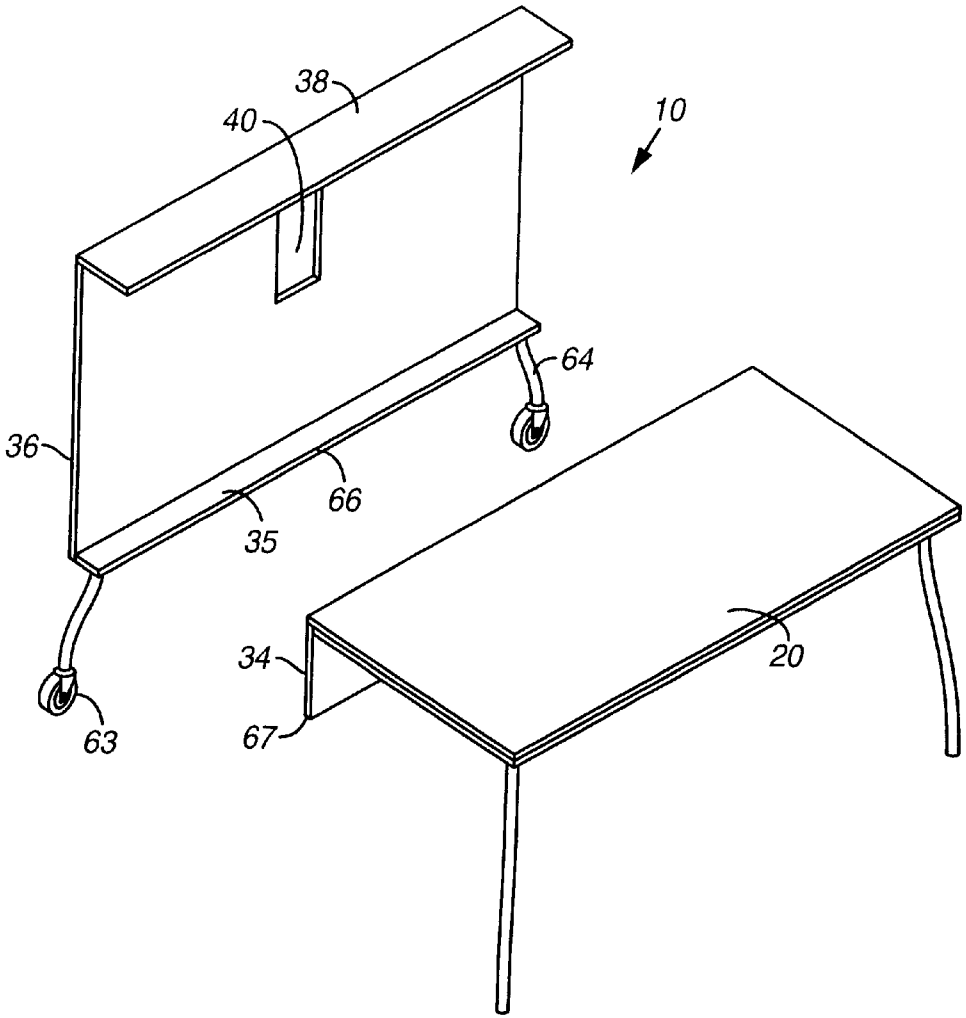
FIG. 3 is a front exploded view of the desk shown in FIGS. 1, 2*a* and 2*b;*
Figure 4:
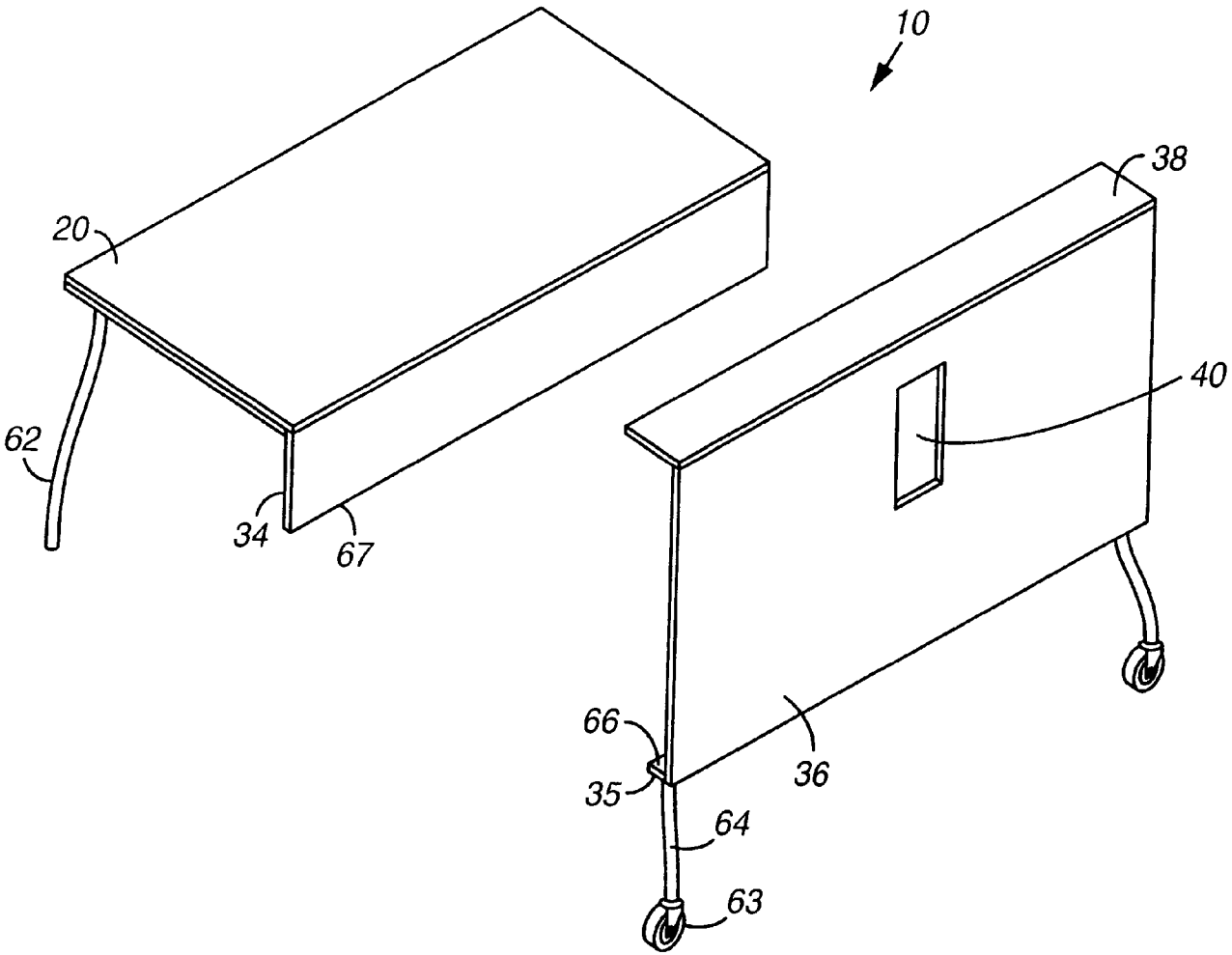
FIG. 4 is a rear exploded view of the desk shown in FIG. 3.

Turning now to FIGS. 3 and 4, desk 10 is preferably assembled by attaching bottom edge 67 of vertical member 34 to surface 66 of bridge member 35. Attachment can be accomplished by any means commonly employed in the art including, but not limited to, mechanical fasteners and adhesives. In desk 10, the positioning and configuration of cable channel 32 provides the lower region of back 36 with the dual function of forming a component of cable channel 32 as well as forming a modesty panel that depends from work surface 20. Positioning of rear legs 64 on the undersurface of bridge member 35 causes cable channel 32 to also perform a leg support function for a portion of the distance below work surface 20. This reduces the amount of metal utilized in rear legs 64 and thus desk 10. In the most preferred form, cable channel 32 has a thickness or spacing between vertical member 34 and back 36 of approximately two inches, and has a depth or spacing between the upper surfaces of bridge member 35 and work surface 20 of approximately ten and one quarter inches. Other dimensions may be utilized which accommodate cabling for equipment such as computers, modems, ISDNs, telephones, dictating machines, monitors, facsimile machines, photocopiers, image scanners and the like.

Figure 17:
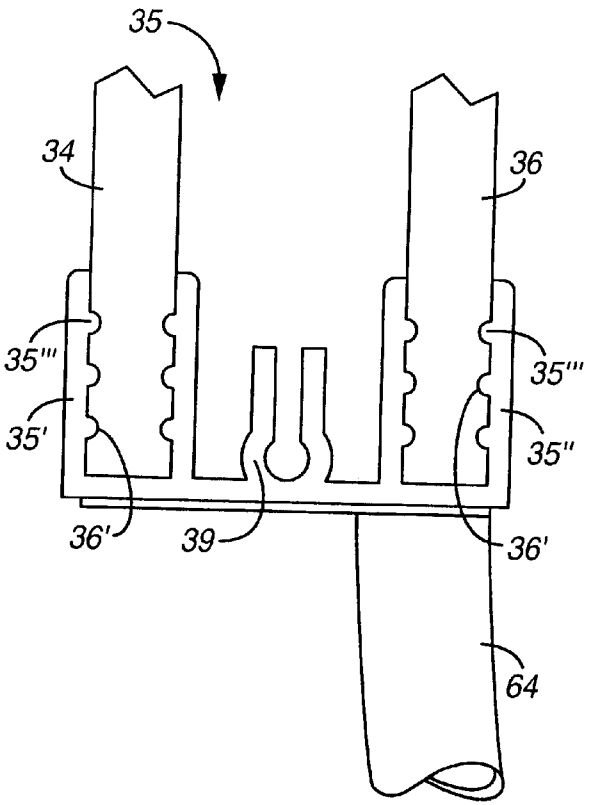
FIG. 17 is a detailed side view of the cable channel of the utility desk illustrated in FIG. 16.
Figure 16:
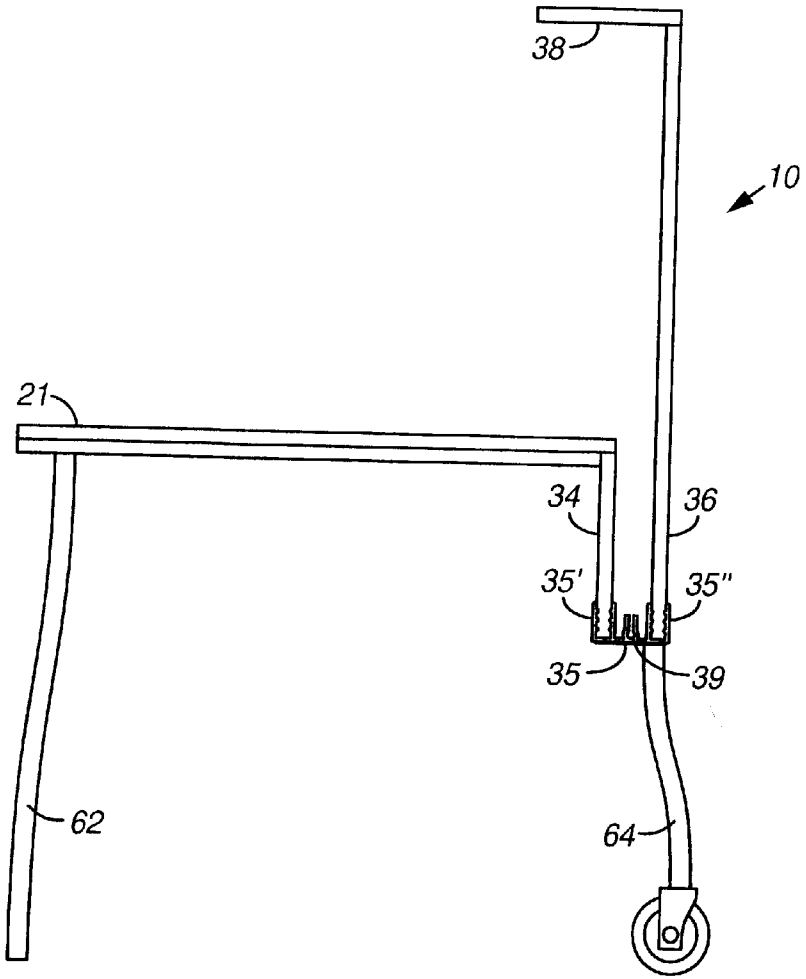
FIG. 16 is a side view of a utility desk according to an alternative preferred embodiment of the present invention.

In a preferred embodiment, as shown in FIGS. 16 and 17, bridge member 35 includes a first pair of vertical uprights 35' and a second pair of uprights 35", dimensioned to receive vertical member 34 and back 36, respectively. Uprights 35' and 35" are formed with teeth 35'" which removably engage mating recesses 36' found in vertical member 34 and back 36. Additionally, bridge member 35 is formed with a cable guide clip 39 dimensioned to accept the electrical cables positioned within bridge member 35. In this embodiment, rear legs 64 are attached to and depend from bridge member 35. Uprights 35' and 35" of bridge member 35 permit facile and secure attachment between vertical member 34 and back 36. Furthermore, the detachable feature of bridge member 35 permits quick dissassembly in the event it is desired to store or transport utility desk 10. In a preferred embodiment, bridge member 35 is made of aluminum.

Turning now to FIGS. 5, 6, 11 and 12, desk 10 may also include a rotatable return 70 attached to a leg 62 and extending therefrom below bottom 23 of work surface 20.

Figure 12:
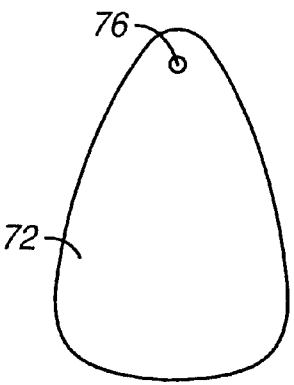
FIG. 12 is a top view of the return illustrated in FIG. 11.
Figure 11:
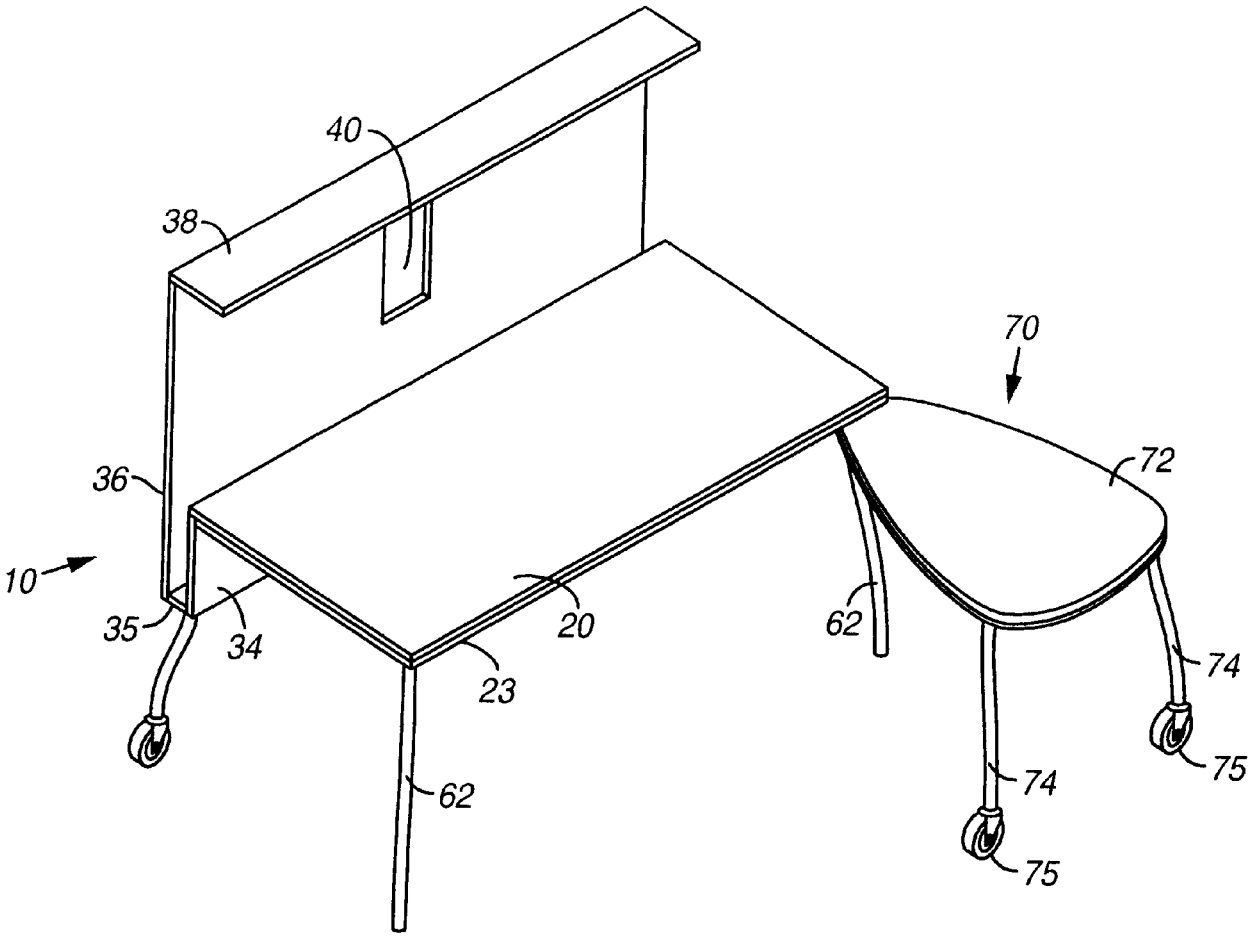
FIG. 11 is a perspective view of a utility desk according to the invention illustrated attached to a return.

Return 70 includes a work surface 72 having a bottom surface 73. A pair of legs 74 depend from bottom surface 73 of work surface 72 with each leg 74 having a wheel or caster 75. As shown in FIG. 12, work surface 72 of return 73 is formed with an aperture 76 dimensioned to loosely surround leg 62. Hence, an individual may utilize return 70 as an additional work surface when needed and when not in use, rotate return 70 such that work surface 72 is positioned under bottom 23 of work surface 20.

In the most preferred embodiment, legs 62, 64 and 74 of desk 10 and return 70 are made of tubular steel and are powder coated. Also, in the most preferred embodiment, work surface 20, vertical member 34, bridge member 35 and back 36 are made of maple, multi-ply or high grade veneered plywood. However, it will be recognized by one with ordinary skill in the art that other materials can be used without departing from the spirit and scope of the present invention.

Figure 19:
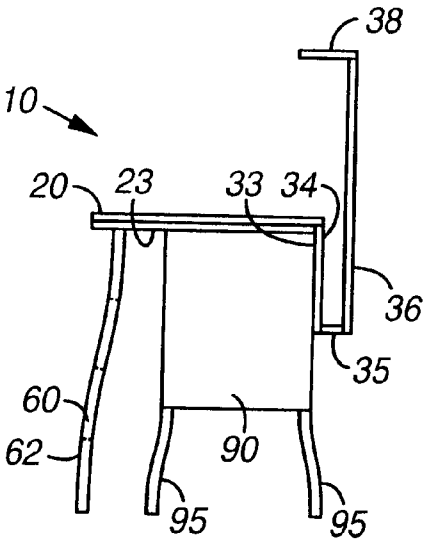
FIG. 19 is a cross-sectional side view taken along line I—I of FIG. 18.
Figure 18:
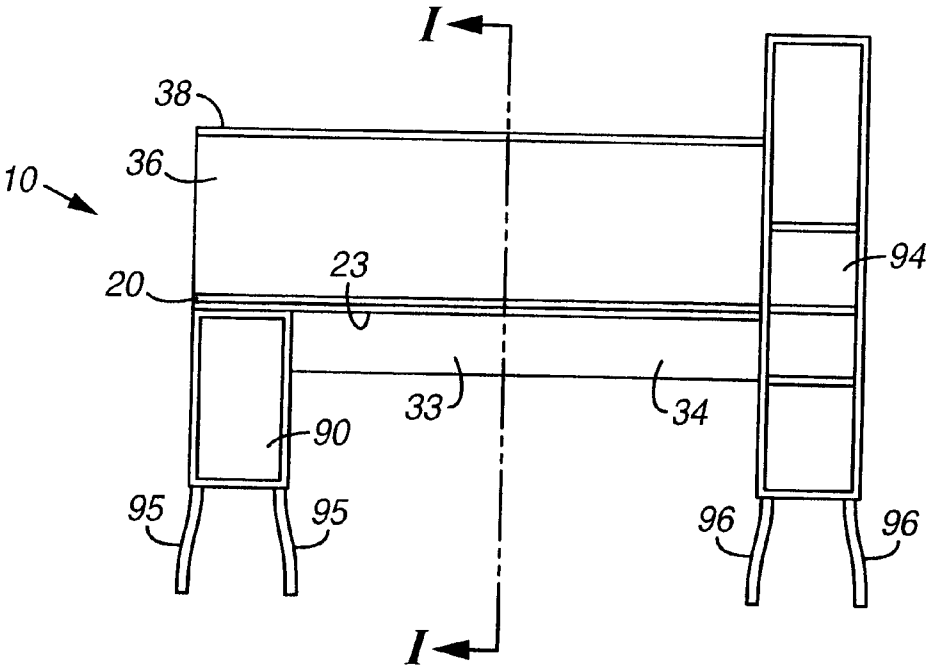
FIG. 18 is a partial cross-sectional front view of a utility desk according to another alternative preferred embodiment of the invention.

Turning now to FIGS. 18 and 19, desk 10 may also include a tower 90 dimensioned to receive and support the central processing unit (CPU) of a computer (not shown). Tower 90 is positioned below bottom 23 of work surface 20, and is preferably flush against surface 33 of vertical member 34. As shown in FIG. 18, a vertical shelving unit 94 is positioned against, and preferably attached to, side 28 of work surface 20. In this embodiment, legs 64 (FIG. 16) of bridge member 35 are replaced by legs 95 (FIG. 18) depending from tower 90 and legs 96 of vertical shelving 94.

Figure 13:
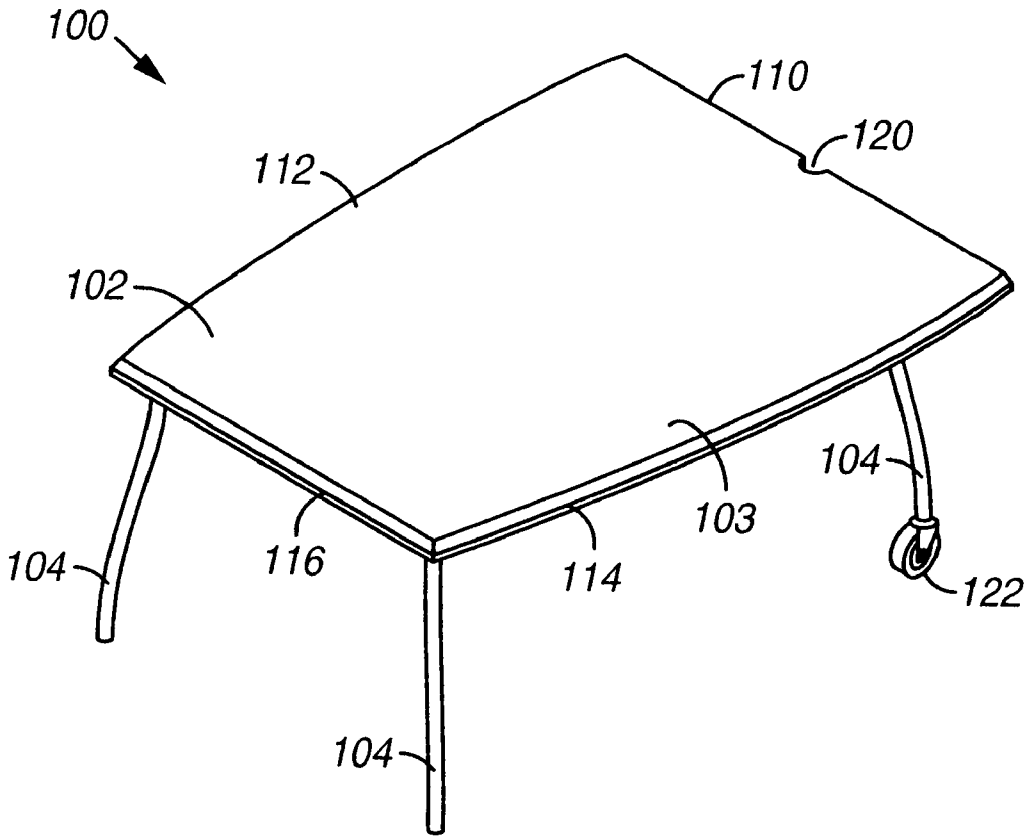
FIG. 13 is a perspective view of a conference table according to the invention.
Figure 14:
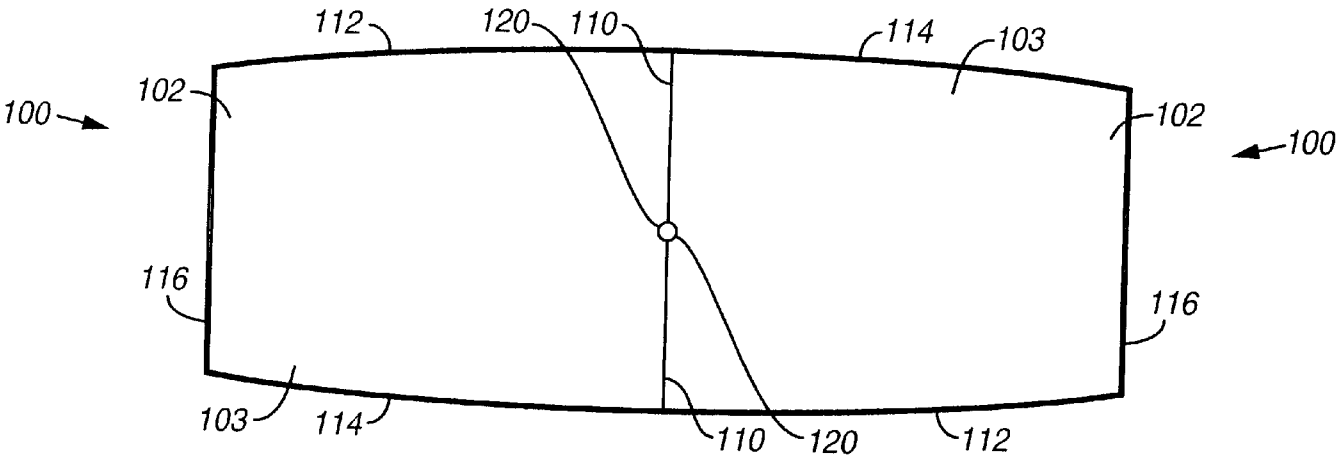
FIG. 14 is a top view illustrating a pair of conference tables according to the invention shown in the juxtaposed position.
Figure 15:
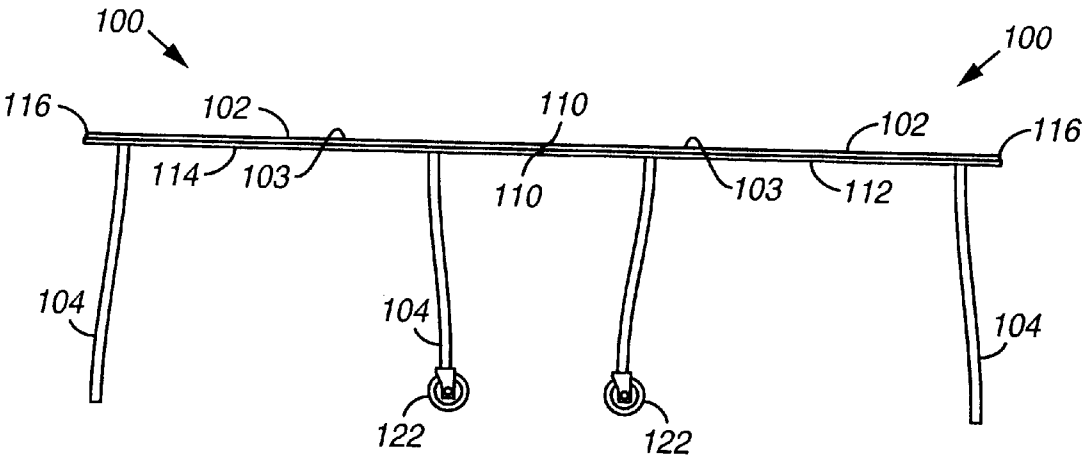
FIG. 15 is a front view of the conference tables illustrated in FIG. 14.

In another aspect, the present invention is embodied in a unique conference table, a preferred embodiment of which is shown in FIGS. 13 through 15, and generally designated by reference numeral 100. Conference table 100 includes a work surface 102 having a plurality of legs 104 depending therefrom which support work surface 102 a preselected distance above the floor. Work surface 102 includes a front 110, opposing sides 112 and 114 and a rear 116. Formed in front 110 of work surface 102 is a cutout section 120. Preferably, cutout section 120 is in the shape of a half circle. Legs 104, positioned proximate to front 110 of work surface 102, are each fitted with a wheel or caster 122 to permit movement of conference table 100.

As shown in FIGS. 14 and 15, conference table 100 is preferably used in conjunction with a second conference table 100. In this embodiment, conference tables 100 are juxtaposed such that fronts 110 of work surfaces 102 are placed in abutting contact. When so positioned, cutout sections 120 are positioned in registration, and together form a circular aperture. This circular aperture is dimensioned to permit electrical cables to extend therethrough and thus provides a more convenient method for supporting electrical devices upon top 103 of work surface 102 and subsequently connecting electrical apparatus to an electrical outlet. Alternatively, conference table 100 may be provided with a plurality of circular apertures forming cable access ports through work surfaces 102. A plurality of cutout sections 120 may be provided along fronts 110 in order to form a plurality of cable access openings when work surfaces 120 are mated. Also alternatively, conference tables 100 may be mated with one or more additional spacing sections that have a planar upper surface and opposing facing sides that abuttingly mate with fronts 110 and opposed side edges that conform to the configuration of sides 112 and 114. Such spacing sections may be fitted with support legs or alternatively fasteners that connect to work surfaces 102, and include cutout sections that mate with cutout sections 120.

In the most preferred embodiment, front 110 of work surface 102 has a length of approximately 44.38 inches, rear 116 has a length of approximately 36.0 inches and opposing sides 112 and 114 have a length of approximately 60.0 inches.

It is to be understood that the foregoing is a description of the preferred embodiments. One skilled in the art will recognize that variations, modifications, and improvements may be made without departing from the spirit and scope of the invention disclosed herein. The scope of protection is to be measured by the claims which follow and the breath of interpretation which the law allows, including the doctrine of equivalents.

The embodiments of the invention in which an exclusive property or privilege is claimed are defined as follows:

1. A desk, comprising:

a desk top having an upper work surface, a rear edge, and a bottom surface;

a plurality of legs extending downwardly from said bottom surface of said desk top;

a cable channel extending downwardly from said bottom surface of said desk top proximate said rear edge, said cable channel having a vertical member attached at its upper end to said bottom surface, a bridge member extending generally horizontally from a lower end of said vertical member, and a back member extending substantially vertically from said bridge member to an elevation above said upper work surface of said desk top and spaced from said vertical member, said cable channel dimensioned to receive at least one electric cable attached to an electrical apparatus positioned on said upper work surface.

2. The desk as recited in claim 1, further comprising a return rotatably attached to at least one leg of said plurality of legs.

3. The desk as recited in claim 2, wherein said return further comprises:

a work surface rotatably attached to said at least one leg of said plurality of legs of said desk; and a pair of legs depending from said work surface of said return.

4. The desk as recited in claim 3, wherein each leg of said pair of legs of said return is attached to a caster.

5. A desk, comprising:

a desk top having an upper work surface, a rear edge, and a bottom surface; and a cable channel extending downwardly from said bottom surface of said desk top proximate said rear edge, said cable channel having a vertical member attached at its upper end to said bottom surface, a bridge member extending generally horizontally from a lower end of said vertical member, and a back member extending substantially vertically from said bridge member and upwardly at least as high as said upper work surface of said desk top and spaced from said vertical member.

6. A desk, comprising:

a desk top having an upper work surface, a rear edge, and a bottom surface; and a cable channel attached to said bottom surface of said desk top proximate said rear edge, said cable channel having a vertical member attached at its upper end to said bottom surface, a bridge member extending generally horizontally from a lower end of said vertical member, and a back member extending substantially vertically from said bridge member and a shelf attached to said back member.

7. A desk, comprising:

a desk top having an upper work surface, a rear edge, and a bottom surface;

a plurality of legs extending downwardly from said bottom surface of said desk top; and a cable channel attached to said bottom surface of said desk top proximate said rear edge, said cable channel having a vertical member attached at its upper end to said bottom surface, a bridge member extending generally horizontally from a lower end of said vertical member, and a back member extending substantially vertically from said bridge member above said upper work surface of said desk top and spaced from said vertical member, and having a window therein.

8. The desk as recited in claim 7, further including an adjustable shade attached to said back member proximate said window.

9. The desk as recited in claim 7, further comprising a return rotatably attached to at least one of said plurality of legs.

10. A desk, comprising:

a desk top having an upper work surface, a rear edge, and a bottom surface; and a cable channel extending downwardly from said bottom surface of said desk top proximate said rear edge, said cable channel having a vertical member attached at its upper end to said bottom surface, a bridge member extending generally horizontally from a lower end of said vertical member, and a back member extending substantially vertically from said bridge member, upwards at least as high as said upper work surface of said desk top and spaced from said vertical member; and at least one leg attached to and extending downwardly from said bridge member.

11. The desk as recited in claim 10, wherein said at least one leg is attached to a caster.

12. A desk comprising:

a substantially planar work surface of predetermined dimension having an opposing top and bottom surfaces, and a perimeter edge including a back edge; and a U-shaped channel having at least one leg attached to said bottom surface of said work surface proximate said back edge and a back member extending substantially vertically from said U-shaped channel and spaced from said back edge of said work surface, and a shelf attached to and extending from said back member.

13. The desk as recited in claim 12, wherein said back member includes a window opening.

14. The desk as recited in claim 13, further including a window covering attached to said back member proximate said window opening and adapted to cover at least a portion of said window opening.

15. The desk as recited in claim 12, further including at least one leg attached to said bottom surface of said work surface.

16. The desk as recited in claim 12, further including at least one leg depending from an exterior surface of said cable channel.

17. The desk as recited in claim 12, further comprising a return rotatably attached to the desk.

18. A desk, comprising in combination:

a work surface of predetermined dimension having a top and bottom, and a perimeter edge including a back edge; and a modesty panel depending from said bottom of said work surface proximate said back edge, said modesty panel in a form of a U-shaped channel having a vertical member attached to said work surface adjacent said back edge, a bridge member attached to said vertical member, and a back member attached to said bridge member and spaced from said vertical member and extending substantially vertically therefrom to an elevation at least as high as said work surface.

19. The desk as recited in claim 18, wherein said back member includes a window opening.

20. The desk as recited in claim 18, further including at least one leg attached to said bottom surface of said work surface.

* * * * *